United States Patent [19]

Springer et al.

[11] 4,381,790

[45] May 3, 1983

[54] ROLLER CLIP

[75] Inventors: William E. Springer, Bridgeport, Conn.; Stewart K. Kurtz, Mt. Kisco, N.Y.

[73] Assignee: Clairol Incorporated, New York, N.Y.

[21] Appl. No.: 310,694

[22] Filed: Oct. 13, 1981

Related U.S. Application Data

[63] Continuation of Ser. No. 115,653, Jan. 28, 1980, abandoned.

[51] Int. Cl.[3] ..... A45D 2/24

[52] U.S. Cl. ..... 132/37 R; 132/46 R; 132/48 R

[58] Field of Search ..... 132/37, 46, 48

[56] References Cited

U.S. PATENT DOCUMENTS

| | | | |
|---|---|---|---|
| 133,785 | 9/1942 | Reynold's | 132/46 A |
| 3,417,761 | 12/1968 | Kulnis et al. | 132/48 R |
| 3,568,687 | 3/1971 | Ciccone | 132/46 A |
| 3,595,246 | 7/1971 | Rusnak | 132/46 A |

FOREIGN PATENT DOCUMENTS

| | | | |
|---|---|---|---|
| 245994 | 3/1911 | Fed. Rep. of Germany | 132/48 R |

*Primary Examiner*—G. E. McNeill

*Attorney, Agent, or Firm*—Isaac Jarkovsky; John J. Balser; Gerald S. Rosen

[57] ABSTRACT

A roller clip having three prongs is disclosed. It comprises a u-shaped member as a first leg terminating in a first longitudinal member and a second leg terminating in a second longitudinal member. The first and second longitudinal members are parallel and the first and second legs are interconnected by an interconnecting portion. A third longitudinal member projects from the interconnecting portion and is substantially parallel to the first and second longitudinal members. The third longitudinal member terminates in an upturned end. A handle also projects from the interconnecting portion and is generally located in the plane of the u-shaped member. Preferably, the handle and the third longitudinal member are integral and form an obtuse angle therebetween. The first and second longitudinal members may be flat and a notch for latching is provided between the first leg and the first longitudinal member and between the second leg and the second longitudinal member.

10 Claims, 5 Drawing Figures

ROLLER CLIP

This is a continuation of application Ser. No. 115,653, filed Jan. 28, 1980, now abandoned.

DESCRIPTION

BACKGROUND OF THE INVENTION

1. Field of the Invention

The invention generally relates to a clip structure and particularly, a roller clip for engaging a hair roller having hair wrapped thereabout.

2. Description of the Prior Art

There have been many hair clips provided for hair rollers particularly for hair dresser use as well as for use in the home. Most of these clips have been made of metal and are stamped out having relatively sharp edges at the sides. In many respects, these clips are uncomfortable to wear and are very difficult to handle. For example, U.S. Pat. No. 3,030,969 to Epstein relates to a hair-retaining device having a flattened lower leg which terminates in a flattened end portion forming a part of a looped handle which terminates in a flattened upper leg.

Three-pronged hairclips have been suggested by U.S. Pat. Nos. 3,003,505; 3,568,687; and 3,595,246. In addition, U.S. Pat. No. D. 199,348 suggests a three-pronged hair roller clip. However, these three-pronged structures have generally been found to be cumbersome or difficult to manufacture. One three-pronged roller clip is presently used with hairsetters, however, it is awkward to grasp since the handle is flat and perpendicular to the axis. In addition, these roller clips are not notched on the legs and cannot satisfactorily retain their position on the roller.

Thus, there is a need for a roller clip which is easily grasped by the user and which also can be retained on the roller without slippage.

SUMMARY OF THE INVENTION

It is an object of this invention to provide a three-pronged roller clip having a handle which can easily be grasped.

It is the further object of this invention to provide a three-pronged roller clip which can be quickly and conveniently molded in the form of an integral structure.

It is another object of this invention to provide a three-pronged roller clip having notches in the leg portions which engage the rim of the roller, preventing slippage and enabling the clip to firmly anchor the roller so no unwanted unrolling occurs.

It is another further object of this invention to provide a three-pronged roller clip which not only firmly anchors the roller but enables the roller to be used closer to each other than rollers anchored with conventional roller clips.

The roller clip according to the invention is comprised of a u-shaped member having legs which terminate in longitudinal members. The longitudinal members are generally parallel. A third longitudinal member projects from the base of the u-shaped member and is formed integral with a handle which also projects from the base of the u-shaped member. The handle is preferably located in the same plane as the u-shaped member. A notch is provided at the interconnection between the longitudinal members and the legs of the u-shaped member to latch the clip to the rim of the roller. In the preferred embodiment, the entire clip structure is an integral molded plastic unit made with a two section mold. The placement of the roller clips is such that there are no visible indentations on the unrolled hair since the legs of the clip rest on the head and any indentation caused by them would be on inside of the hair.

BRIEF DESCRIPTION OF THE DRAWINGS

These features and objects of the invention will become apparent to those skilled in the art by referring to the attached drawings in which.

a.

b.

c.

d.

DETAILED DESCRIPTION OF THE INVENTION

Figure 1:
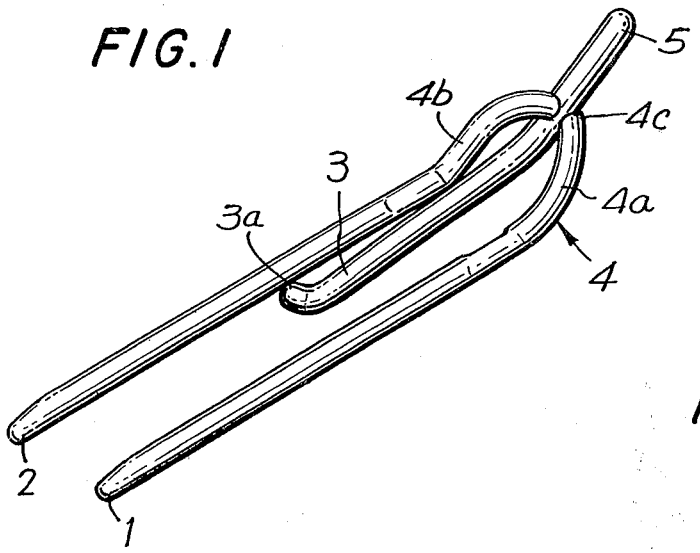
FIG. 1 is a perspective view of the roller clip according to the invention.

The roller clip according to the invention is illustrated in perspective view in FIG. 1. A u-shaped member 4 is comprised of a first leg 4*a*, a second leg 4*b* and an interconnecting portion 4*c*, interconnecting the first and second legs 4*a*, 4*b*. In fact, the interconnecting portion 4*c* is the base of the u-shaped member 4. The first leg 4*a* terminates in a first longitudinal member 1 which forms a first obtuse angle 9 with leg 4*a*. The first longitudinal member 1 is preferably provided with a tapering surface 1*a* and a flat terminating end 1*b*. The second leg 4*b* terminates in a second longitudinal member 2. The angle between the second leg 4*b* and the second longitudinal member 2 is equal to obtuse angle 9 so that the first and second longitudinal members 1, 2 are substantially parallel.

Figure 4:
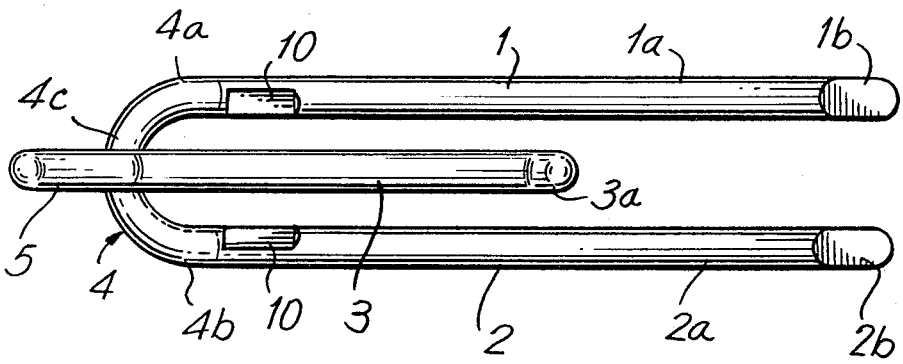
FIG. 4 is a top view of the roller clip according to the invention; and e.
Figure 5:
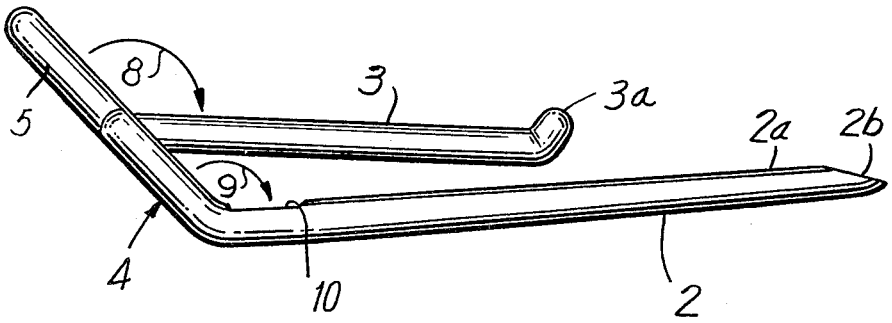
FIG. 5 is a side view of the roller clip according to the invention.

A third longitudinal member 3 projects from the interconnecting portion 4*c* and, from a top point of view as shown in FIG. 4, is substantially parallel to the first and second longitudinal members 1, 2. The third longitudinal member 3 terminates in an upturned end 3*a*.

Figure 2:
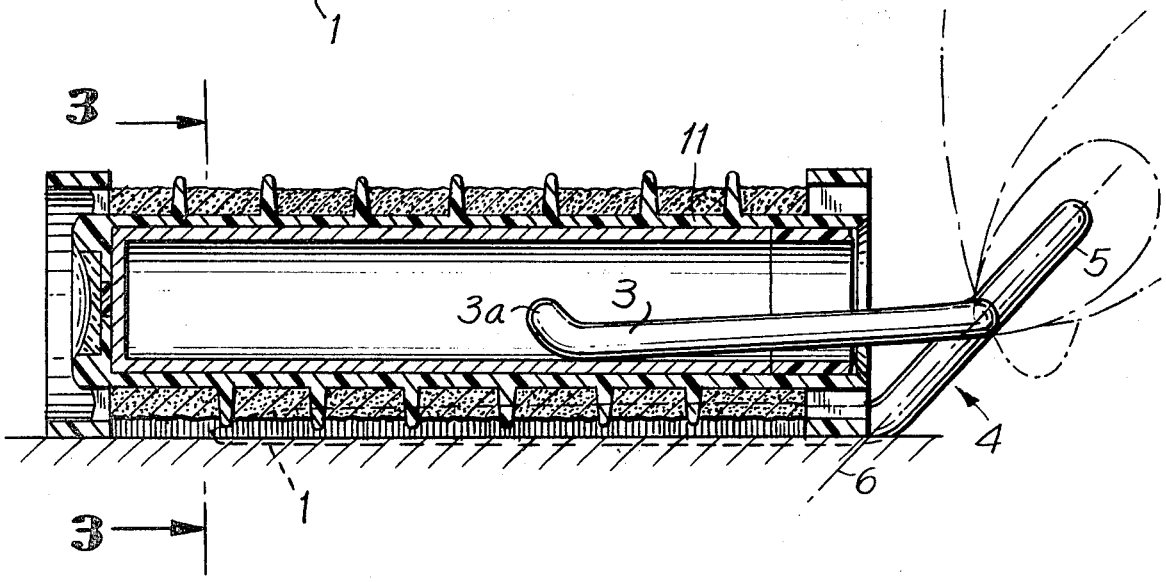
FIG. 2 is a longitudinal sectional view of the roller clip according to the invention engaging a hair curler.
Figure 3:
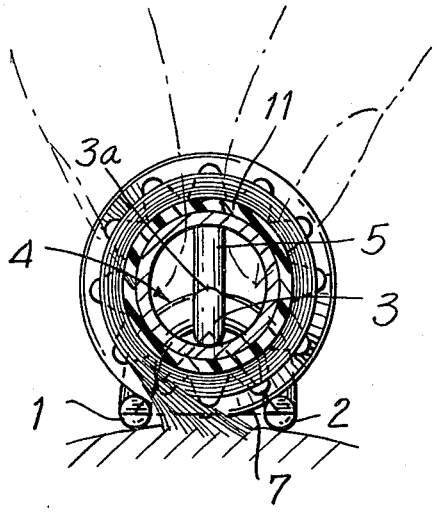
FIG. 3 is a cross-sectional view taken along lines 3—3 of FIG. 2.

Also projecting from the interconnecting portion 4*c* is a handle 5. In the preferred embodiment, the handle 5 forms an integral part with the third longitudinal member 3. The obtuse angle 8 forms between the handle 5 and the third longitudinal member 3 is greater than obtuse angle 9. As shown in FIG. 2, the u-shaped member 4 and the handle 5 are located in the same plane indicated by the dotted line referred to by reference character 6. In addition, from a cross-sectional point of view, the first, second and third longitudinal members 1, 2, 3 are located at the apexes of isosceles triangle 7.

Preferably, the entire clip structure according to the invention is an integral molded plastic unit with the third longitudinal member 3 and the handle 5 forming an integral section and the interconnecting portion 4*c* projecting from either side of the intermediate point between the third longitudinal member 3 and the handle 5. As shown in FIG. 4, the interconnection point between the legs and the longitudinal members may be provided with a notch 10 which increases the flexibility of the longitudinal members with respect to the u-shaped member 4.

In use, the clip is grasped by the handle 5 so that the clip may slidably engage the roller 11. Specifically, the roller is engaged between the first and third longitudinal members and between the second and third longitudinal members. The upturned end 3*a* of the third longitudinal member 3 allows the roller to be engaged between the third longitudinal member and the first and second longitudinal members so that the clip may be pushed onto the hair roller 11. Therefore, the first and second longitudinal members rest against the scalp and anchor the hair against the hair roller 11. The third longitudinal member is inserted into the curler. Because the first and second longitudinal members rest against the scalp, they not only anchor the hair against the curler, they anchor the roller against the head. Because their configuration results in a stable roller, a minimum amount of hair is needed for each roller enabling the rollers to be used closer together than was previously possible.

Of particular interest is the configuration of the handle 5 and the configuration of the ends of the first and second longitudinal members 1 and 2. These features of the invention allow the clip to be quickly and conveniently picked up so that, with a natural motion, the clip may be used correctly to engage a roller 11. The ends of the first and second longitudinal members 1, 2 are smooth and slightly flattened as indicated by reference characters 1*a* and 2*a* to enable the clip to rest against the scalp and clip a minimum amount of hair onto the roller in such a way that any indentation left in the hair as a result of the clip and the heated roller would be toward the scalp and not visible until unrolled. Notches provided in the first and second longitudinal members latch the clip in place to the roller rim, providing stability.

Various changes may be made in the details of the invention, as disclosed, without sacrificing the advantages thereof or departing from the scope of the attendant claims. Furthermore, although the present invention has been disclosed and discussed with particular regard to its exceptional advantages in terms of a hair roller clip, it may be understood that the invention may be employed in several industrial applications wherein the engagement of a tubular structure is required.

What is claimed is:

1. A roller clip comprising:

a. A U-shaped member having a first leg terminating in a first longitudinal member, a second leg terminating in a second longitudinal member, wherein said first and second legs and said longitudinal members form a first obtuse angle therebetween from a side point of view, and an interconnecting portion interconnecting the first leg and the second leg and wherein said first longitudinal member and said second longitudinal member, from a side point of view, are in the same plane;

b. A third longitudinal member projecting from said interconnecting portion and wherein said third longitudinal member, from a side point of view, is in a plane above the first and second longitudinal members along its entire length;

c. A handle projecting from said interconnecting portion whereby a curler may be engaged between the first longitudinal member and the third longitudinal member, and between the second longitudinal member and the third longitudinal member so that the first and second longitudinal members rest on the scalp; and wherein notches are provided between the first leg and the first longitudinal member and between the second leg and the second longitudinal member.

2. The roller clip of claim 1 wherein said handle and said u-shaped member are located in the same plane.

3. The roller clip of claim 2 wherein said handle and said third longitudinal member form an integral portion.

4. The roller clip of claim 3 wherein said handle and said third longitudinal member form a second obtuse angle therebetween.

5. The roller clip of claim 4 wherein the first obtuse angle is greater than the second obtuse angle.

6. The roller clip of claim 5 wherein said first and second longitudinal members have substantially tapering surfaces.

7. The roller clip of claim 6 wherein, from a top point of view, the first, second and third longitudinal members are substantially parallel.

8. The roller clip of claim 7 wherein, in a longitudinal cross-section, the first, second and third members are located at the apices of an isosceles triangle.

9. The roller clip of claim 8 wherein said third longitudinal member terminates in an upturned end.

10. The roller clip of claim 9 wherein said clip is formed of an integral, molded plastic structure.

* * * * *